US007277055B2

(12) United States Patent
Tamaoka

(10) Patent No.: US 7,277,055 B2
(45) Date of Patent: Oct. 2, 2007

(54) COMPACT ANTENNA

(75) Inventor: Hiroyuki Tamaoka, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/396,624

(22) Filed: Apr. 4, 2006

(65) Prior Publication Data

US 2006/0176220 A1 Aug. 10, 2006

Related U.S. Application Data

(63) Continuation of application No. PCT/JP2004/013415, filed on Sep. 15, 2004.

(30) Foreign Application Priority Data

Apr. 9, 2004 (JP) ..... 2004-116116

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 873, 846

See application file for complete search history.

(56) References Cited

U.S. PATENT DOCUMENTS 4,980,694 A * 12/1990 Hines ..... 343/702
5,541,610 A * 7/1996 Imanishi et al. ..... 343/702
6,181,278 B1 * 1/2001 Kakimoto et al. ... 343/700 MS

FOREIGN PATENT DOCUMENTS

| | | |
|---|---|---|
| JP | 05-259724 | 10/1993 |
| JP | 2001-223519 | 8/2001 |
| JP | 2002-076735 | 3/2002 |
| JP | 2002-158529 | 5/2002 |
| JP | 2002-290132 | 10/2002 |
| JP | 2002-299933 | 10/2002 |
| JP | 2003-163528 | 6/2003 |
| JP | 2003-218623 | 7/2003 |
| WO | WO 01/06596 | 1/2001 |
| WO | WO 01/18909 | 3/2001 |

* cited by examiner

*Primary Examiner*—Hoanganh Le
(74) *Attorney, Agent, or Firm*—Oblon, Spivak, McClelland, Maier & Neustadt, P.C.

(57) ABSTRACT

The multi-band antenna 1 is provided with a dielectric having the three-layer structure obtained by stacking layers so as that a central dielectric layer 12 made of a low dielectric constant material is sandwiched by lower and upper side dielectric layers 11, 13 made of high dielectric constant materials, a fed element 12 formed between the central dielectric layer 12 and the upper dielectric layer 13 and its base end being connected to a feed point on a specified side face of the dielectric having the three-layer structure, a grounded parasitic element 22 formed between the central dielectric layer 12 and the lower dielectric layer 11 and its base end being grounded on a specified side face, wherein the fed element 21 and the grounded parasitic element 22 is formed from the base end to the open end by a element obtained by connecting a plurality of line conductors and folding at least around the side face opposite to the specified face.

18 Claims, 11 Drawing Sheets

(A−A') cross sectional view (a)

(b)

COMPACT ANTENNA

CROSS-REFERENCE TO RELATED APPLICATIONS

This application is a continuation of international patent application PCT/JP04/013415, filed Sep. 15, 2004, which is based upon and claims the benefit of priority from prior Japanese Patent Application No. 2004-116116, filed Apr. 4, 2004, the entire contents of each are incorporated herein by reference.

FIELD OF THE INVENTION

The present invention relates predominantly to a multi-band antenna commonly available in a plurality of frequency bands, especially, to the multi-band antenna of which the size can be reduced so as to be built inside such as mobile terminals.

BACKGROUND TO THE INVENTION

Recently, the use of mobile terminals such as mobile phones is widely spread, which has made it important to reduce the size of the antenna used in mobile terminals in order to make these mobile terminals small. Especially, antennas which can completely be built inside the mobile terminals without protruding from the mobile terminals are demanded. Moreover, since a plurality of communication methods have spread for the mobile communication, the multi-band antennas are required, which are able to transmit and receive in a plurality of bands, as antennas for mobile terminals operate in various communication systems. Accordingly, various multi-band antennas which can be built inside mobile terminals are proposed (for example, refer to Japanese Patent Provisional Publication No. 2002-314326).

However, if the size of the antenna is reduced regardless of being a line antenna or planar one, it is difficult to maintain the required wide-band characteristics. Especially, adopting the method for reducing the size of the antenna by increasing the dielectric constant of the dielectric material surrounding the whole antenna makes it difficult to find appropriate design conditions which maintain the wide-band characteristics. Thus, the configuration of the prior art has a problem, for the use of the multi-band antenna which can be built inside a mobile terminal, that it is difficult to realize the reduction of the size of the antenna element with maintaining the wide-band characteristics.

Accordingly, the present invention is made to solve the problems like this and has an object of providing a compact antenna which is suitable to be built inside mobile terminals and able to realize both the reduction of the element size and the low profile with maintaining the wide-band characteristics, by adopting the configuration which is obtained by combining the dielectrics having three layered structure with a fed element and a grounded parasitic element.

SUMMARY OF THE INVENTION

In a first embodiment of the compact antenna of the invention, the compact antenna comprises a dielectric having a three-layer structure formed by sandwiching a first dielectric layer made of a low dielectric constant material between a second dielectric layer and a third dielectric layer made of high dielectric constant materials, a fed element which is formed between said first dielectric layer and said second dielectric layer and its base end is connected to a feed point on a specified side face of the dielectric having said three-layer structure, and a grounded parasitic element which is formed between said first dielectric layer and said third dielectric layer and its base end is grounded on said specified side face.

According to the present invention, wide-band characteristics can be secured by utilizing electromagnetic coupling occurring between the fed element and the grounded parasitic element which are arranged to oppose each other via the dielectric layer having low dielectric constant. Here, the dielectrics arranged on the top and bottom sides do not have big influence on the electromagnetic couplings occurring between these elements. Therefore, a sharp reduction of size can be possible with maintaining the wide-band characteristics.

In the second embodiment of the compact antenna of the invention, the compact antenna further comprises a shorting conductor which electrically connects the open end of said fed element with the open end of said grounded parasitic element through said first dielectric layer.

According to the present invention, by electrically shorting the open end of the fed element and the open end of the grounded parasitic element, an adequate electromagnetic coupling is obtainable between the feed and grounded parasitic elements, which therefore makes it easy to adjust the impedance and to operate in the wide band.

In the third embodiment of the compact antenna of the invention, said fed element and said grounded parasitic element of the compact antenna have elements consist of line conductors formed so as to be obtainable a plurality of reflection points.

According to the present invention, further wide-band characteristics can be secured by forming multiple modes using the electromagnetic coupling occurs between two conductor elements which are arranged to oppose each other on the top and bottom sides of the dielectric layer made of a low dielectric constant material. Furthermore, a multi-band antenna which is available for multi-band use with maintaining the reduced size of the antenna can be provided, by means of the fed element and the grounded parasitic element having antenna elements formed by combining line conductors in order to be able to obtain a plurality of reflection points.

In the fourth embodiment of the compact antenna of the invention, said fed element and said grounded parasitic element have antenna elements each of which is formed by connecting a plurality of line conductors from the base end to the open end and bending the conductors at least in the vicinity of the side face opposing to said specified side face.

According to the present invention, since a plurality of reflection points can be obtained by bending the conductors at least in the vicinity of the side face opposing to said specified side face, a multi-band antenna which is available for multi-band use can be provided.

In the fifth embodiment of the compact antenna of the invention, on at least the outer dielectric layers of said three dielectric layers, low dielectric constant patterns having dielectric constants lower than that of said dielectric are provided along the longitudinal direction of said dielectric.

According to the present invention, in addition to the effect mentioned above, it is possible to reduce an unnecessary electric coupling occurs between the conductor element and the grounded parasitic element, which enables to secure the effect of broadening the wide band.

In the sixth embodiment of the compact antenna of the invention, said low dielectric constant patterns are formed between the two conductors which consist of a plurality of line conductors.

According to the present invention, in addition to the effect mentioned above, it is possible to secure the effect of broadening the wide band with maintaining the effect of lowering the frequency band.

In the seventh embodiment of the compact antenna of the invention, said low dielectric constant patterns are configured by air holes (slits).

According to the present invention, low dielectric constant patterns are easy to obtain.

In the eighth embodiment of the compact antenna of the invention, said fed element and said grounded parasitic element consist of conducting elements which are obtained by folding in the vicinity of said each specified side face and also in the vicinity of the each side face opposite to said specified side faces in triple row, the central conductors of said conducting elements are placed on the opposite positions sandwiching said first dielectric inbetween.

According to the present invention, in addition to the effect mentioned above, by employing conducting elements in triple row obtained by folding twice as the fed element and the grounded parasitic element, it is possible to realize the multi-band antenna commonly available in three band operation.

In the ninth embodiment of the compact antenna of the invention, said fed element and said grounded parasitic element are placed on the place slightly shifted from the opposing position in the surface of said each dielectric layer.

According to the present invention, in addition to the effect mentioned above, it is possible to control adequately the extent of the electromagnetic coupling occurring between opposing fed element and grounded parasitic element in the upper and lower sides, which enables to improve the antenna characteristics by suppressing unnecessary couplings.

In the tenth embodiment of the compact antenna of the invention, said fed element and said grounded parasitic element are configured with the conducting elements having shapes similar to each other.

According to the present invention, in addition to the effect mentioned above, since the fed element and the grounded parasitic element opposing to each other at the upper and lower sides have the same shape, it is easy to adjust resonance frequencies and the antenna characteristics.

In the eleventh embodiment of the compact antenna of the invention, either of both the fed element and grounded parasitic element is/are configured so as to include meander lines.

According to the present invention, in addition to the effect mentioned above, since the antenna is configured by using conducting elements include the meander lines, it is possible to secure long line length in a narrow region, which enables to reduce the size of the antenna even for the low frequency operation.

In the twelfth embodiment of the compact antenna of the invention, said dielectric having the three-layer structure is placed in the notch portion obtained by removing the ground plane at the corner of a circuit board, and said circuit board is formed with the feed point to which the base end is connected and the ground point to which the base end of said grounded parasitic element is connected.

According to the present invention, in addition to the effect mentioned above, since it is possible to generate magnetic current, between the excited compact antenna and the edge portion of the ground plane, which works as a radiation source, it is possible to avoid the protrudent structure and realize low-profile with maintaining the wide-band characteristics of the compact antenna.

In the thirteenth embodiment of the compact antenna of the invention, said dielectric having the three-layer structure is placed in the notch portion so as to make the direction of the face of said each dielectric layer and that of said circuit board approximately coincide with each other.

According to the present invention, in addition to the effect mentioned above, since the dielectric having the three-layer structure is placed in the notch portion of the circuit board so as to make both directions of the faces coincide with each other.

In the fourteenth embodiment of the compact antenna of the invention, said dielectric having the three-layer structure is placed on said notch portion so as to make the direction of the face of said each dielectric layer and that of said circuit board approximately orthogonal to each other.

According to the present invention, in addition to the effect mentioned above, since the dielectric having the three-layer structure is placed on the notch portion of the circuit board so as to make both directions of the faces orthogonal to each other, it is possible to concentrate the electromagnetic field between upper sides of the compact antenna and the circuit board, and make hard to affected by the parts just below the antenna, and further realize the compact antenna having a stable characteristics in both open and closed states occur to the fold-type housing.

In the fifteenth embodiment of the compact antenna of the invention, resins such as PEI (PolyEtherImide), LCP (Liquid Crystal Polymer) are adopted for the dielectric layer made of said low dielectric constant material.

According to the present invention, in addition to the effect mentioned above, it makes possible to form easy and to improve the properties necessary to the dielectric material and a thermal property.

In the sixteenth embodiment of the compact antenna of the invention, resonant frequencies corresponding to said respective reflection points are to be adjusted by adjusting the spatial distance between said base end of said conductor element and said each reflection point.

According to the present invention, in addition to the effect mentioned above, it is possible to easily obtain the necessary frequency bands for the multi-band antenna.

In the seventeenth embodiment of the compact antenna of the invention, the impedances of said respective resonant frequencies are to be adjusted so as to coincide with each other by adjusting the relative position between the folded portion of said fed element and the folded portion of said grounded parasitic element.

According to the present invention, in addition to the effect mentioned above, it is possible to easily adjust the impedance in order to broaden the frequency band.

In the eighteenth embodiment of the compact antenna of the invention, said resonant frequencies and said impedance are to be adjusted by adjusting the positions and lengths of said low dielectric constant patterns having linear shapes formed at least to said outer dielectric.

According to the present invention, in addition to the effect mentioned above, it is possible to easily adjust the impedance for adjusting the resonant frequencies and broadening the frequency bands.

According to the present invention, since the dielectric having three-layer structure and the fed element and the grounded parasitic element are combined, and each conducting element is configured so as to have folded antenna elements by connecting line conductors, it is possible to realize the multi-band antenna which, with maintaining the broad band properties obtained by the effect of electromagnetic coupling, enables to reduce its size and to make low-profile and is suitable to be built inside the mobile terminals.

DETAILED DESCRIPTION OF THE INVENTION

Referring now to accompanying drawings, preferred embodiments in accordance with the present invention will be explained hereinafter. Hereinafter, three representative embodiments of a compact multi-band antenna which can operate at in least two different frequency bands and be built in mobile terminals are explained as embodiments in accordance with the present invention.

FIRST EMBODIMENT

Figure 1:
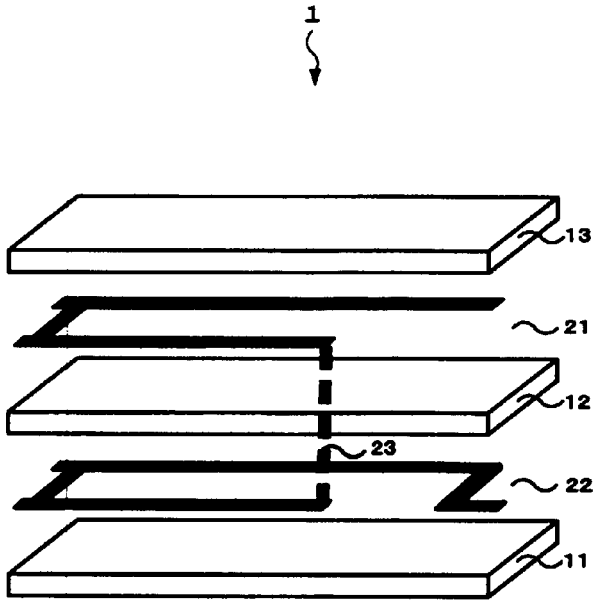
FIG. 1 is a perspective view that illustrates the structure of the multi-band antenna in accordance with the first embodiment of the multi-band antenna.

The configuration of the multi-band antenna in accordance with a first embodiment of the present invention will be explained first with referring to accompanying drawings. FIG. 1 is a perspective view that illustrates the structure of the multi-band antenna in accordance with the first embodiment. And, FIG. 2 is a schematic view that illustrates the configuration of the antenna elements of the multi-band antenna shown in the FIG. 1.

As illustrated in FIG. 1, the multi-band antenna 1 in accordance with the first embodiment has a stacked-layer structure which is obtained by stacking three layers consisting of a first dielectric layer 11, a second dielectric layer 12, and a third dielectric layer 13 in this order from the bottom side. Moreover, a fed element 21 is formed as an antenna element between the second dielectric layer 12 and the third dielectric layer 13, and a grounded parasitic element 22 is formed between the first dielectric layer 11 and the second dielectric layer 12. And then, a shorting conductor 23 is formed in order to short the open ends of the fed element 21 and the grounded parasitic element 22 through the first dielectric layer 11. Accordingly, respective dielectric layers and conductors mentioned above are unified.

In FIG. 1, while both the first dielectric layer 11 formed on the lower side and the third dielectric layer 13 formed on the upper side are made of high dielectric constant materials, only the second dielectric layer 12 of the central portion consists of a low dielectric constant material. That is, the multi-band antenna 1 has the stacked-layer structure obtained by sandwiching the low dielectric constant material with two layers made of high dielectric constant materials. The dielectrics of the respective layers can be formed, for example, by using the dielectric materials having dielectric constants less than or equal to 20 for the first dielectric layer 11 and the third dielectric layer 13 and by using the dielectric materials having dielectric constants less than or equal to 4 for the second dielectric layer 12. Hereat, size and dielectric constant of each first, second, and the third dielectric layer 11, 12 and 13 can be appropriately determined depending on operation bands, desired antenna characteristics, etc.

Figure 2:
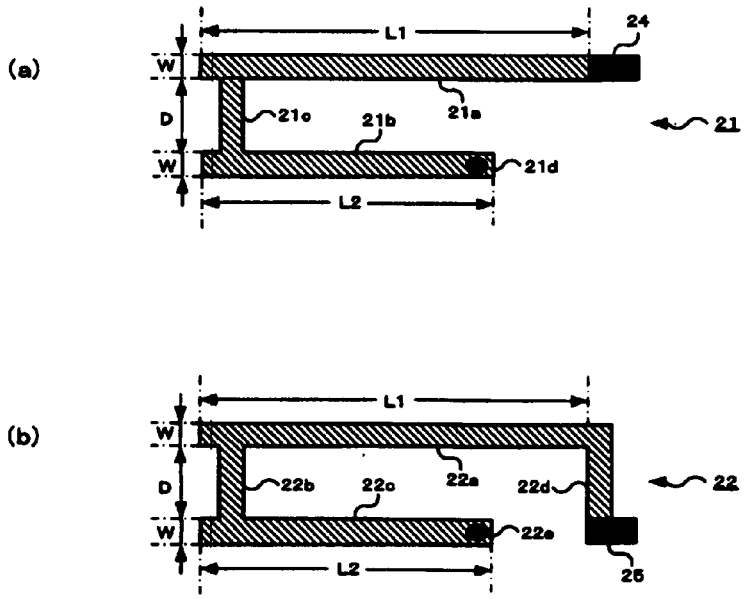
FIG. 2 is a schematic view that illustrates the configuration of the antenna elements of the multi-band antenna shown in FIG. 1.

Hereat, the configuration of respective elements of the fed element 21 and the grounded parasitic element 22 are explained by using FIG. 2. As shown in FIG. 2(*a*), the fed element 21 is formed, from the base end to the open end, by folding a planer line conductor which is obtained by connecting three line conductors 21*a*, 21*b*, and 21*c*. The line conductor 21*a* has a shape of ribbon of which the length along the transverse direction is L1 and the width is W. The line conductor 21*b* is placed in a plane parallel to the line conductor 21*a* with a distance of D from it and has a shape of ribbon of which the length along the transverse direction is L2 and the width is W. The arrangement like this forms the quasi-stacked-layer structure with respect to the edge of a ground plane. And, the line conductor 21*c* is an element having a length of D, which elongates so as to connect the end of the line conductor 21*a* to the end of the line conductor 21*b*.

A feed port 24 is attached at the base end of the line conductor 21*a*. This feed port 24 is a terminal for being connected to the feeding point of a circuit board described below. On the other side, a connection port 21*d* is attached at the open end of the line conductor 21*b*. The end of the shorting conductor 23 which pierces through the second dielectric layer 12 is connected to this connection port 21*d*. As mentioned above, the fed element 21, that is, a line conducting element is configured, which extends from the base end of the feed port 24 to the connecting port 21*d* obtained by connecting line conductor 21*a*, 21*c*, and 21*b* in this order.

Hereat, parameters such as lengths L1, L2, width W, distance D illustrated in FIG. 2(*a*) can be adequately determined depending on the impedance and each property of the multi-band antenna 1. Moreover, although, in the example illustrated in FIG. 2(*a*), the line conductor 21*a* and the line conductor 21*b* have widths of a similar value W and each conductor is placed parallel, both of them may be placed slightly off parallel each other on the condition that they are placed in the different parallel planes and each of them may have a different width and shape.

Next, as shown FIG. 2(*a*), grounded parasitic element 22 is formed, from the base end to the open end, by folding planer line conductor which is obtained by connecting four line conductors 22*a*, 22*b*, 22*c*, and 22*d*. Among them, the line conductors 22*a*, 22*b*, and 22*c* have sizes and arrangements similar to that of line conductors 21*a*, 21*b*, and 21*c* of the fed element 21 illustrated in FIG. 2(*a*).

However, the grounded parasitic element 22 is different from the fed element 21 in the point of view that the end of the line conductor 22*d* elongated in the longitudinal direction is connected to the base end of the line conductor 22*a*. And, a ground port 25 is formed on the other end of the line conductor 22*d*. The ground port 25 is a terminal for being connected to the ground plane of the circuit board described below. As shown in FIG. 2, the reason why the positions of the feed port 24 and ground port 25 are different from each other is to make that they don't overlap each other during a process for connecting the multi-band antenna to the circuit board. As mentioned above, the grounded parasitic element 22, that is, a line conducting element is configured, which extends from the base end of the ground port 25 to the connecting port 22*e* obtained by connecting line conductor 22*d*, 22*a*, 22*c*, and 22*b* in this order.

As shown in FIG. 2, the fed element 21 and grounded parasitic element 22 have shapes similar to each other, each of which has an folded portion. By placing each element having similar shape nearby, it becomes possible to generate multiple modes between two conductors, which enables to broaden the operation band. Moreover, by forming the folded portion considering the relative position from the edge of the ground plane, a plurality of resonance peaks appear as mentioned below, which makes possible to resonate in a plurality of frequencies.

Furthermore, since the fed element 21 and the grounded parasitic element 22 are connected at each open end by the shorting conductor 23, a three dimensional antenna element connected in one is configured and operates as a multi-band antenna in accordance with the first embodiment. Although, in the first embodiment, the configuration that the fed element 21 and the grounded parasitic element 22 are connected with the shorting conductor 23 is shown, it is also possible to configure the multi-band antenna 1 without adopting the shorting conductor 23 by setting each open end of the fed element 21 and grounded parasitic element 22 open-circuited.

Moreover, the parameters such as length L1, L2, width W, distance D, and the relative position, shapes, etc. of the line conductors 22*a*, 22*b* can be set adequately, which is similar to the case of FIG. 2(*a*). In this case, parameters and shapes of respective fed element 21 and grounded parasitic element 22 can be set not only the same but also different each other.

Figure 3:
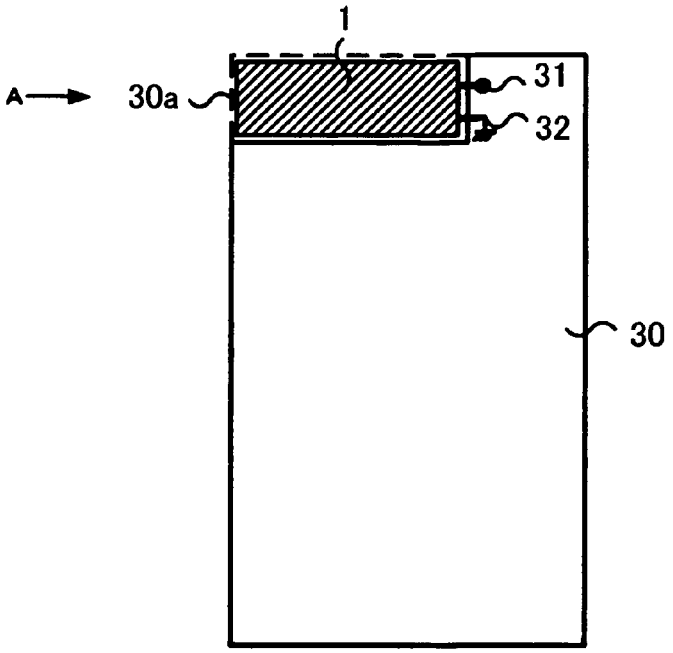
FIG. 3 is a schematic view that illustrates the arrangement, in which the multi-band antenna in accordance with the first embodiment of the multi-band antenna is mounted on a circuit-board.
Figure 4:
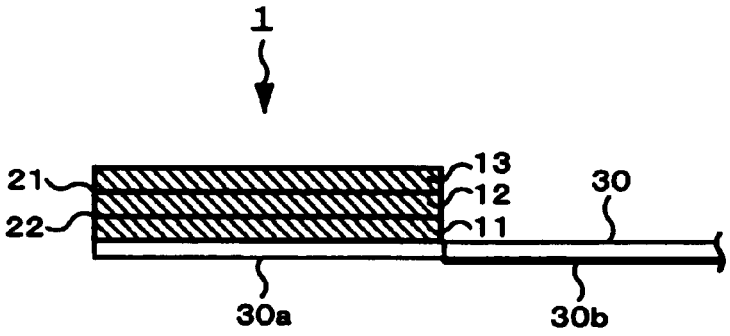
FIG. 4 is a side view from the direction indicated by an arrow A shown in FIG. 3.

Referring now to FIGS. 3 and 4, the arrangement of the multi-band antenna 1 mounted inside a mobile terminal with the circuit board is explained. FIG. 3 is a schematic view that illustrates the arrangement of the multi-band antenna 1 mounted on the circuit board 30, and FIG. 4 is a side view from the direction indicated by an arrow A shown in FIG. 3. In FIG. 3, the circuit board 30 set up inside a mobile terminal, on which a wireless circuit, a control circuit, etc. are loaded, includes a ground plane 30*b* all of which is electrically fixed to a GND level. To the circuit board 30, a notch portion 30*a* is formed at an upper corner by removing the ground plane 30*b* so as that the shape of the multi-band antenna 1 has approximately the same as that of the ground plane 30*b* and the multi-band antenna 1 can be put on the notch portion 30*a*.

And then, the multi-band antenna 1 is placed so as to coincide its shape with that of the notch portion 30*a* of the circuit board 30. Hereat, as illustrated in FIG. 4, an arrangement is realized such that the first dielectric layer 11 is placed right on the circuit board 30, and the second dielectric layer 12 and the third dielectric layer 13 are placed on the upper portion thereof. The notch portion 30*a* is preferable to have a size at least similar to or slight larger than that of the antenna of the multi-band antenna 1.

As illustrated in FIG. 3, a feeding point 31 and a ground point 32 are formed on the portion, of the circuit board 30, near the multi-band antenna 1. The feed port 24 and ground port 25 are protruding from the multi-band antenna 1, the feed port 24 is connected to the feeding point 31, and the ground port 25 is connected to the ground point 32. Consequently, the multi-band antenna 1 operates as an antenna, for transmitting and receiving, used for the mobile terminal in which the circuit board 30 is loaded.

Figure 5:
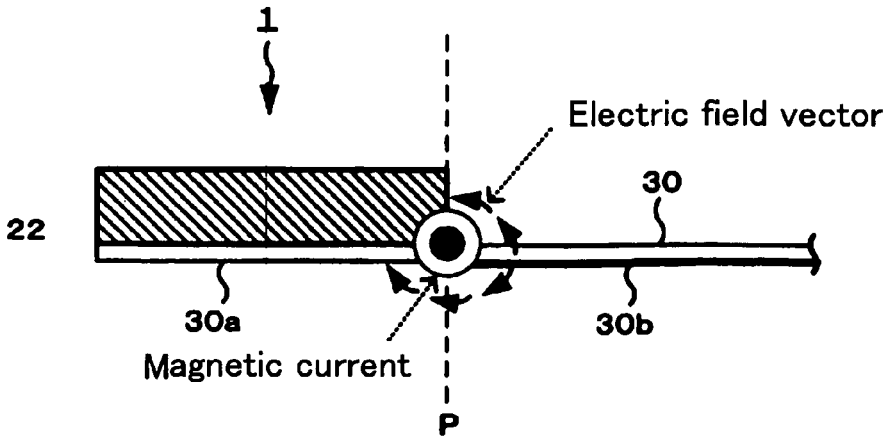
FIG. 5 is a schematic view that illustrates the electric field generated around the multi-band antenna mounted on a circuit board, for explaining the principle of the radiation of the multi-band antenna in accordance with the first embodiment of the multi-band antenna.

Next, an explanation is performed on the principle of the radiation from the multi-band antenna 1 in accordance with the first embodiment. In the first embodiment, the structure of the multi-band antenna itself and the way of mounting on the circuit board 30 make it possible to obtain the low profile of the multi-band antenna 1 without a loss of the wide-band characteristics. FIG. 5 illustrates electric field, using vectors, generated around the multi-band antenna 1 mounted on the circuit board 30, in order to explain the principle of the radiation from the multi-band antenna 1.

As shown in FIG. 5, when the multi-band antenna 1 is excited, a fringing electric field occurs between the edge region (position P indicated in FIG. 5) of the ground plane 30*b* formed in the circuit board 30 and the side of the multi-antenna 1. Hereat, a magnetic current is generated in the direction defined by the outer product of the electric field vector and an outward normal vector (in the direction normal to the plane of FIG. 5). The magnetic current distributes along the side of the multi-band antenna 1 in the place P. Since, as mentioned above, an equivalent slot of the magnetic current shown in FIG. 5 dominantly works as a radiation source and operates as a planer-antenna rather than a usual line antenna, the multi-band antenna 1 in accordance with the first embodiment is adequate to make low-profile.

Figure 6:
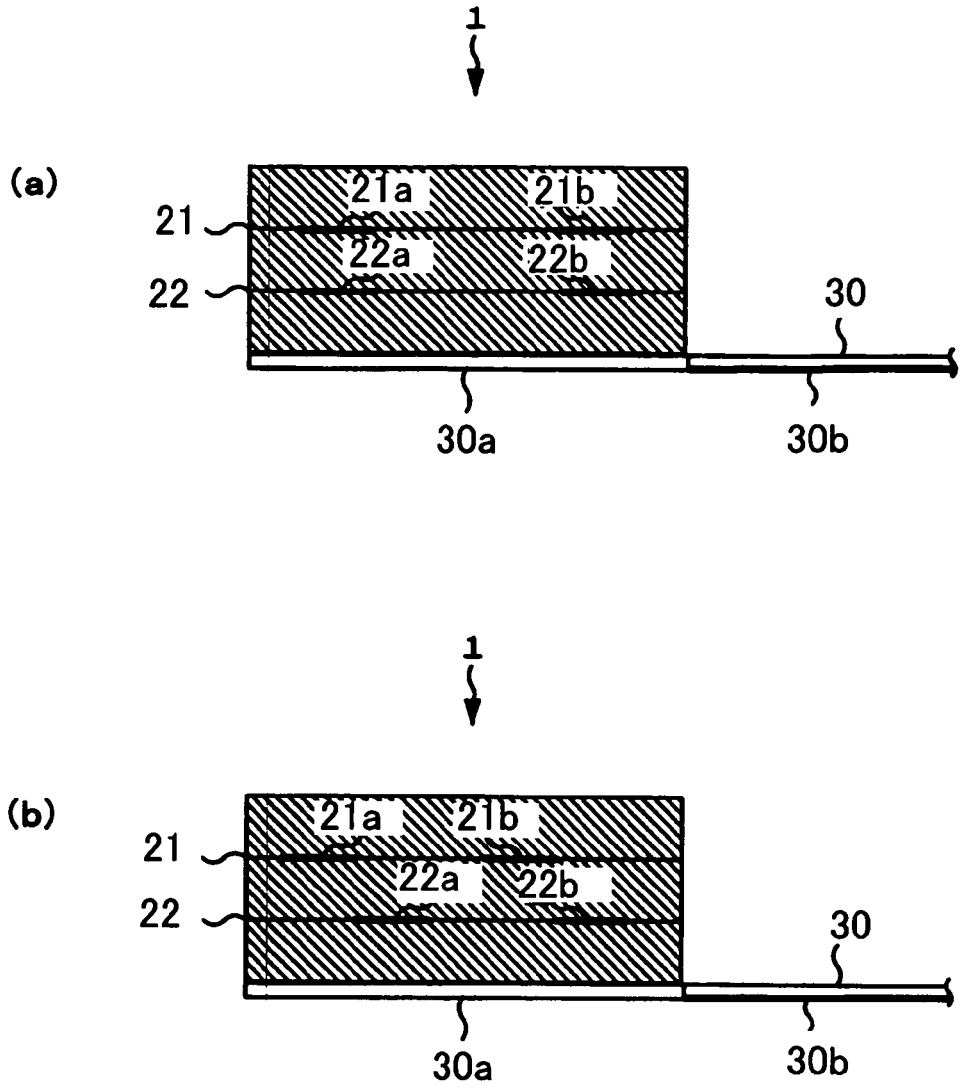
FIG. 6 is a schematic view that illustrates two kinds of arrangement of the upper fed element and the lower grounded parasitic element.

Now, the explanation is carried out on the relative position, along the direction of thickness, of the fed element 21 and the grounded parasitic element 22 which comprise the multi-band antenna 1. In FIG. 6, two examples are illustrated as the relative positions between the upper fed element 21 and lower grounded parasitic element 22. FIG. 6(*a*) illustrates an example that the line conductors 21*a*, 21*b* of the fed element 21 and the line conductor 22*a*, 22*b* of the grounded parasitic element 22 are placed on the opposing position in the plane of each dielectric layer. To the contrary, FIG. 6(*b*) illustrates an example that the line conductors 21*a*, 21*b* of the fed element 21 and the line conductor 22*a*, 22*b* of the grounded parasitic element 22 are placed on positions slightly shifted from the opposing position in the plane of each dielectric layer in the direction parallel to each plane.

In general, magnetic couplings and electric couplings occur between two conductors placed in the vicinity of each other. In case of the multi-band antenna 1 in accordance with the first embodiment, although there are couplings in the direction parallel to the planes (transverse) in which the fed element 21 and the grounded parasitic element 22 are placed, as mentioned above, from the point of view of the principle of the radiation, the influence of the magnetic couplings between the fed element 21 and the grounded parasitic element 22 is dominant. At this time, the grounded parasitic element 22 is excited by the magnetic couplings with the fed element 21. To the contrary, the electromagnetic couplings between line conductors 21*a*, 21*b* of the fed element 21 and between line conductors 22*a*, 22*b* of the grounded parasitic element 22 are unnecessary couplings from the point of view of the principle of the radiation.

On the other hand, although the electric couplings occur in the arrangement shown in FIG. 6(*a*) which illustrates the fed element 21 and the grounded parasitic element 22 are placed so as to oppose each other with the nearest distance, since the increase of the electric coupling leads to the increase of Q-factor of the antenna, the wide-band characteristic might not be secured in the case of much stronger couplings. Therefore, as shown in FIG. 6(*b*), by placing the elements on positions shifted, in the direction parallel to the planes, from the opposing positions, the strength of the electric coupling can be adjusted adequately. Moreover, regarding the unnecessary magnetic couplings, an optimization can be carried out so as to obtain the desired antenna characteristics by adjusting the strength of the coupling which changes depending on the degree of the shift.

Figure 7:
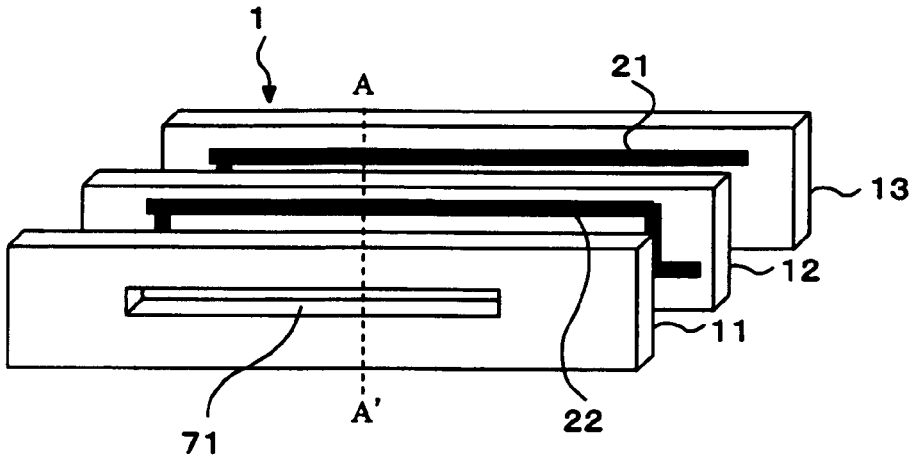
FIG. 7 is a schematic view that illustrates air holes formed through the outer dielectric layers in accordance with the first embodiment of the multi-band antenna.
Figure 7:
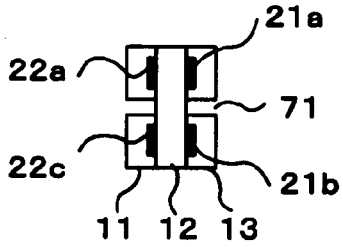

Furthermore, in the configuration shown in FIG. 7, air holes (slits) are formed through at least outer dielectric layers of the dielectric having the three-layer structure as a portion having low dielectric constant. The air holes 71 are formed through the outer dielectric layers 11 and 13 from the front face to the rear face along the longitudinal direction of the outer dielectric layers 11 and 13.

By taking the configuration mentioned above, while it is possible to lower the resonant frequency by placing the dielectric layers 11 and 13 made of the high dielectric constant materials outside the fed element 21 and grounded parasitic element 22, unnecessary couplings between the line conductors 21*a*, 21*b* of the fed element 21 and between the line conductors 22*a*, 22*b* of the grounded parasitic element 22 might be strengthen.

Figure 8:
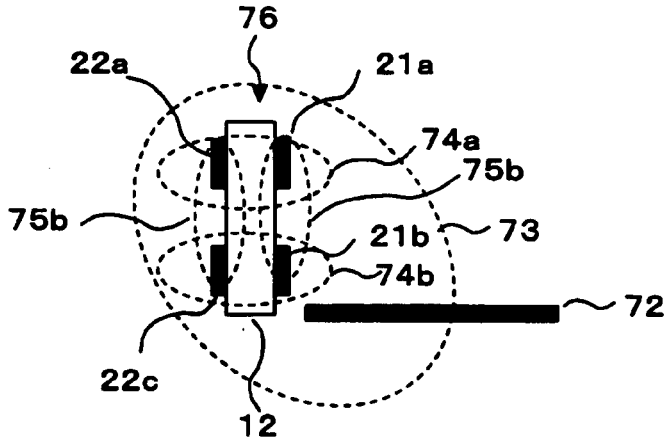
FIG. 8 is a schematic view that illustrates the electromagnetic coupling occurring among the fed element, the grounded parasitic element and a ground plane.

Referring to the FIG. 8, an explanation is carried out on the concept of the electromagnetic coupling. The magnetic couplings include a magnetic coupling 73 between the multi-band antenna 76 and the ground plane 72, a magnetic coupling 74*a* between the line conductor 21*a* of the feel element 21 and the line conductor 22*a* of the grounded parasitic element 22, similarly, the magnetic coupling 74*b* between the ling conductors 21*b* and 22*b* of the fed element 21, magnetic coupling 75*a* between the line conductors 21*a* and 21*b*, and the magnetic coupling 75*b* between line conductors 22*a* and 22*b*. It is also necessary to take into consideration the electric coupling simultaneously. Among them, magnetic couplings 75*a* and 75*b* are unnecessary couplings, and it is necessary to satisfy the following conditions in order to broaden the operation band.

(Couplings 74*a* and 74*b*)>(coupling 73)>(75*a* and 75*b*) (Formula 1)

To the contrary, if the dielectric layers 11 and 13 made of a high dielectric constant material are formed on the outside of the fed element 21 and grounded parasitic element 22, unnecessary couplings 75*a* and 75*b* become strong and the relation represented by Formula 1 changes to (75*a* and 75*b*)>(coupling 74*a* and 74*b*)>(coupling 73) (Formula 2), and the wide-band characteristics might be degraded.

Therefore, air holes (slits) 71 are formed through the outer dielectric layers 11 and 13 as portions having low dielectric constant, which made it possible to optimize the wide-band characteristics. Moreover, the effect of lowering the frequency is not abased by forming the air holes 71. Although, in the configuration illustrated in FIG. 7, air holes are formed through only the outer dielectric layers, it is also possible to realize similarly the effect of broadening the operation band by forming the air holes through the central dielectric layer 12.

In FIG. 7, the fed element 11 and the grounded parasitic element 12 are conductors, each of which is folded in double row. In case of forming the conductors in double row, it is preferable to form the air holes 71 through regions of the outer dielectric layers 11 and 13 corresponding to the regions between conductors folded in double row in the longitudinal direction. By configuring as mentioned above, unnecessary magnetic couplings 75*a* and 75*b* can be diminished more effectively.

As the other effect of forming air holes through the dielectric layers, it is possible to shorten the distance between conductors because of being able to diminish the unnecessary coupling. Consequently, it can be possible to narrow the width of the antenna, which makes it possible to reduce the size of the antenna.

Next, regarding the multi-band antenna 1 in accordance with the first embodiment, based on the fundamental configuration and the principle as mentioned above, an explanation is carried out on the more detail example of the multi-band antenna 1 which can operate in three frequency bands consisting of GSM, DCS, and PCS that are standards for mobile phones. In this example, the multi-band antenna 1 is configured by adopting the meander line as the fed element 21.

Figure 9:
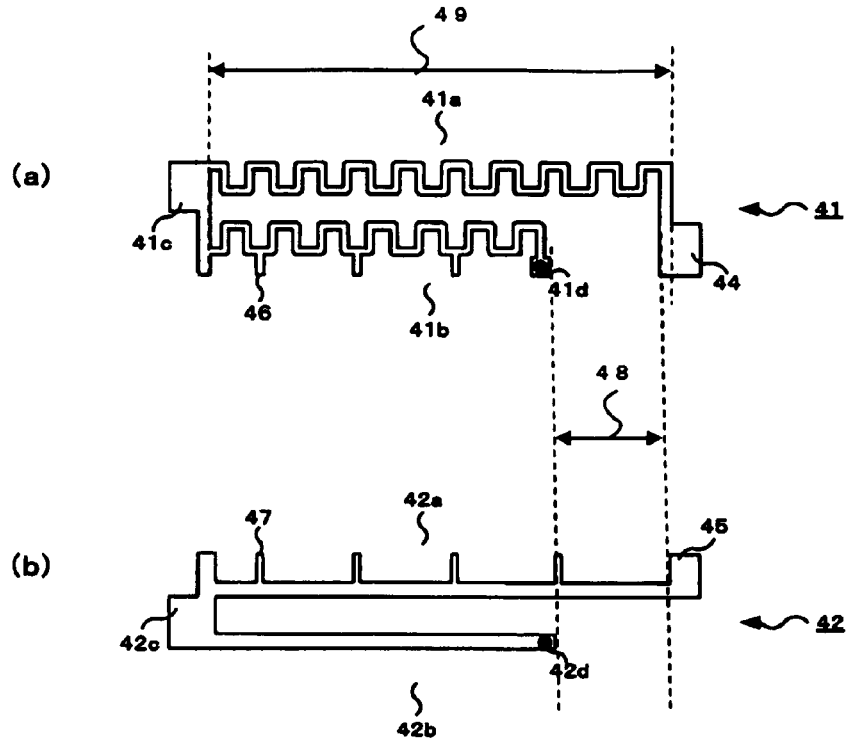
FIG. 9 is a schematic view that illustrates the configuration of the antenna elements in accordance with the Example of the multi-band antenna including the meander lines.

FIG. 9 is a schematic view that illustrates the configuration of the antenna element of the multi-band antenna 1 in accordance with the example. As shown in FIG. 9(*a*), the fed element 41 is configured by adopting the meander lines 41*a*, 41*b* which correspond to the line conductors 21*a*, 21*b* illustrated in FIG. 2(*a*). Moreover, the shorting conductor 41*c* electrically connects an end of the meander line 41*a* and an end of the meander line 41*b*. Furthermore, the feed port 44 is formed on the base end of the meander line 41*a*, and connection portion 41*d* is formed on the open end side.

To the contrary, as shown in FIG. 9(*b*), the grounded parasitic element 42 consists of line conductors 42*a*, 42*b* and the shorting conductor 42*c* which connects these two line conductors 42*a*, 42*b*, without adopting the meander line. Moreover, the ground port 45 is formed on the base end side of the line conductor 42*a*, and the connection portion 42*d* is formed on the open end side of the line conductor 42*b*.

Furthermore, a plurality of stubs 46 are formed on specified positions of the fed element 41, and a plurality of stubs 47 are also formed on specified positions of the grounded parasitic element 42. These stubs 46, 47 have a role of adjusting the impedance of the multi-band antenna 1. Therefore, it is preferable to adequately determine the positions, number, shapes, sizes, etc. of stubs 46, 47 so as that the impedance of the multi-band antenna 1 is optimized.

Thus, in the example illustrated in FIG. 9, since the meander lines 41*a*, 41*b* of the multi-band antenna 1 is formed to have a periodic folded patterns, it is possible to elongate the effective antenna length. Therefore, the multi-band antenna 1 in accordance with the present example has preferable configuration in case of setting the resonant frequency low under the constraint of the same antenna sizes, or reducing the antenna size of the antenna operates in the same resonant frequency.

Withal, regarding the multi-band antenna 1 in accordance with the example shown in FIG. 9, it is also possible to mount the multi-band antenna 1 having the stacked-layer structure basically as shown FIG. 1 on the circuit board 30 by following the arrangement illustrated in FIG. 3 and FIG. 4. However, since, as is apparent by comparing the FIG. 9 with FIG. 2, the relative position between the feed port 44 and ground port 45 is opposite to that of shown in FIG. 2, it is necessary to set also the relative position between the feeding point 31 and the ground point 32 of circuit board 30 opposite. In spite of the case of connecting them having the relative position like this, there is no change in the basic operation of the multi-band antenna 1.

SECOND EMBODIMENT

Hereinafter, the configuration of the multi-antenna in accordance with the second embodiment will be explained, with reference to accompanying drawings. Since the basic configuration of the multi-band antenna is common to that of the first embodiment and the second embodiment, detail explanation is omitted. On the other hand, in the second embodiment, the way of mounting the multi-band antenna on the circuit board is different from that of first embodiment.

Figure 10:
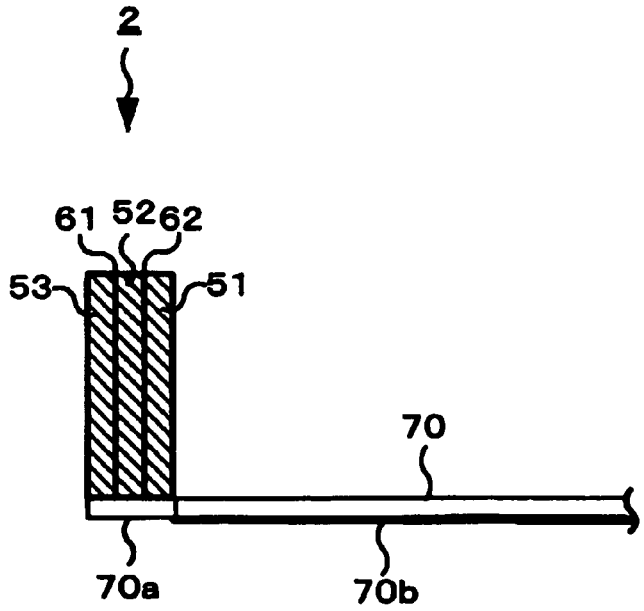
FIG. 10 is a side view that illustrates the multi-band antenna in accordance with the second embodiment mounted on the circuit board.

FIG. 10 is a side view that illustrates the state of the multi-band antenna 2 mounted on the circuit board 70 with a similar manner shown in the FIG. 4. The circuit board 70 shown in FIG. 10 is similar to the circuit board 30 illustrated in FIG. 3, and has a notch portion 70*a* obtained by removing a portion of the ground conductor 70*b*. Hereat, while, in the first embodiment, an arrangement is made so as that each layer of the multi-band antenna 1 is parallel to the face of the circuit board 30, in the second embodiment, each layer of the multi-band antenna 2 is arranged so as to be perpendicular to the face of the circuit board 30. In addition, the first dielectric layer 51, the second dielectric layer 52, and the third dielectric layer 53 are placed, in this order, from the side of the ground conductor 70*b* of the circuit board 70. Moreover, the fed element 61 is formed between the second dielectric layer 52 and the third dielectric layer 53, and the grounded parasitic element 62 is formed between the first dielectric layer 51 and the second dielectric layer.

Thus, in the second embodiment, the direction of the multi-band antenna 2 with respect to the circuit board 70 differs by 90 degrees compared with that of in the first embodiment. Therefore, although the fundamental principle of the radiation is the same as that of the first embodiment, there occur differences in the fringing electric field reflecting the arrangement. According to the way of arrangement set forth in the second embodiment, electric field generated by exciting the multi-band antenna 2 distributes predominantly on the surface of the ground conductor 70*b* of the circuit board 70. Therefore, even in the case that metal parts and such are placed on the notch portion 70*a* just below the multi-band antenna 2, there is a merit of being able to reduce the influence. Moreover, in case of being mounted inside of the fold-type housing, it is possible to reduce the variations of the characteristics caused by opening or closing the housing.

Next, regarding the multi-band antenna 2 in accordance with the second embodiment, similar to the case of the first embodiment, an explanation is carried out on a more detail example of the multi-band antenna 2 which can operate in three frequency bands consisting of GSM, DCS, and PCS. Also in this example, the multi-band antenna 2 is configured by adopting the meander line, similar to that shown in FIG. 9.

Figure 11:
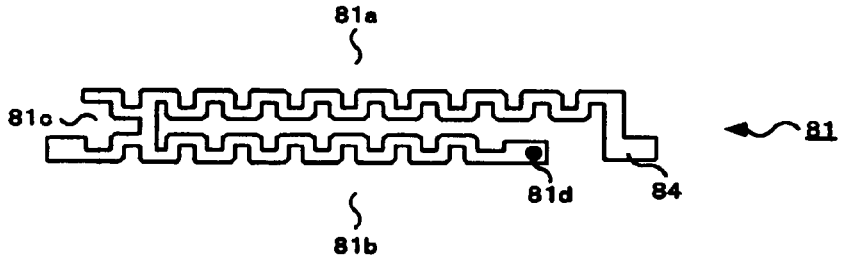
FIG. 11 is a schematic view that illustrates the configuration of the antenna elements of the multi-band antenna in accordance with the second embodiment.
Figure 11:
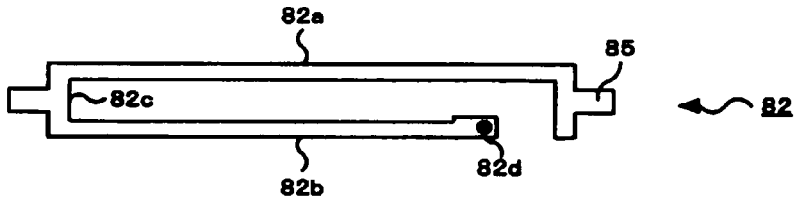

FIG. 11 is a schematic view that illustrates the configuration of the antenna elements of the multi-band antenna 2 in accordance with the example mentioned above. As shown in FIG. 11(*a*), the fed element 81 is configured by employing the meander lines 81*a*, 81*b*, which is similar to that shown in FIG. 9(*a*). Moreover, the shorting conductor 81*c* connects electrically an end of the meander line 81*a* and an end of the meander line 81*b*. Furthermore, a feed port 84 is formed in the base end side of the meander line 81*a*, and the connection portion 81*d* is formed in the open end side of the meander line 81*b*.

On the other hand, as shown FIG. 11(*b*), the grounded parasitic element 82 is configured with line conductors 82*a*, 82*b* and shorting conductor 82*c* which electrically connects these line conductors 82*a*, 82*b*, without employing meander line. Moreover, the ground port 85 is provided on the base end side of the line conductor 82*a* and the connection portion 82*d* is provided on the open end side of the line conductors 82*b*.

In case of the second embodiment, the antenna size can also be reduced similarly to the case of the first embodiment by comprising the antenna elements of the multi-band antenna 2 to include the meander lines 41*a*, 41*b*. Herein, since the multi-band antenna 2 in accordance with the second embodiment is arranged so as to be perpendicular to the face of circuit board 70, it is preferable to set the width of the fed element 81 and grounded parasitic element 82 narrower.

Although, in FIGS. 6 and 10, the multi-band antenna in accordance with the present invention is placed on the opposite side of the face in which the ground electrodes of the circuit board are formed, it could also be possible to place them in the same plane with a slight mounting cost.

THIRD EMBODIMENT

The configuration of the multi-band antenna in accordance with the third embodiment is explained hereinafter, with reference to the accompanying drawings. In the third embodiment, since the basic configuration is also common to that of the first embodiment, the detail explanation is omitted for the brevity and/or the clarity. In the third embodiment, in order to obtain three band operations, the fed element and grounded parasitic element are configured with line conductors folded in triple row.

Figure 12:
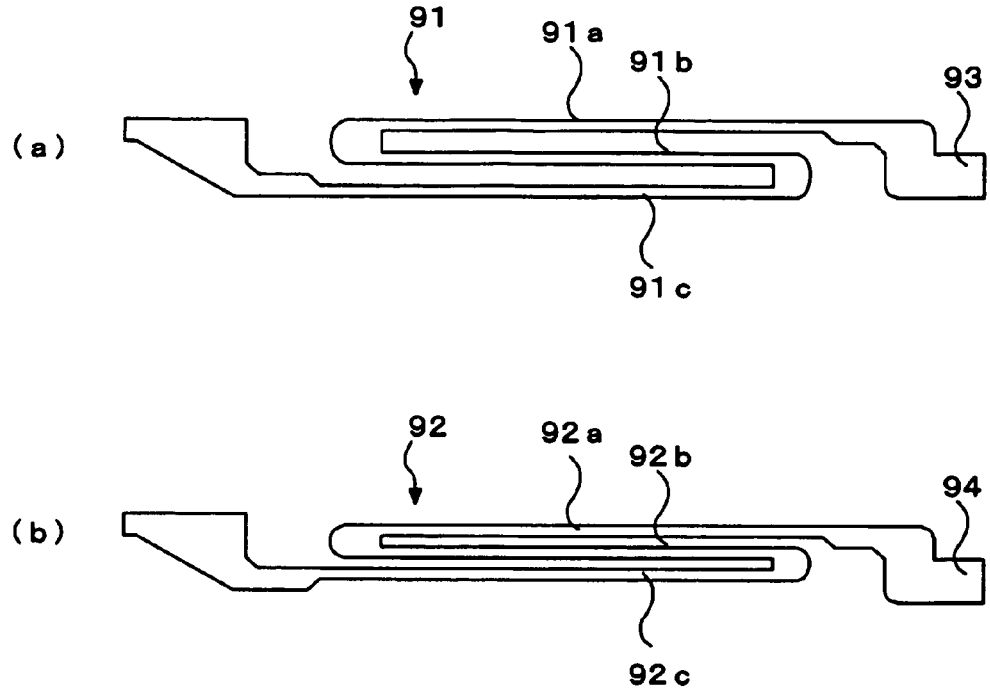
FIG. 12 is a schematic view that illustrates the configuration of the antenna elements of the multi-band antenna in accordance with the third embodiment.

FIGS. 12(*a*) and (*b*) illustrate, respectively, the fed element 91 and grounded parasitic element 92 in accordance with the third embodiment. The fed element 91 and grounded parasitic element 92 have elements consisting of line conductors in triple row each of which is obtained by folding the line conductor near the place opposite to the feed port 93 or ground port 94 and folding further near the place of the feed port 93 or ground port 94, wherein among the line conductors in triple row, each central conductor 91*b*, 92*b* is placed to face each other across the central dielectric 12 at the position where they overlap each other from the direction perpendicular to the plane of the dielectric.

Herein, the shapes of the fed element 91 and grounded parasitic element 92 need not be the same each other and, except for placing the central line conductors 91*b* and 92*b* so as to oppose each other, it could be also possible to change the width and the position in order to adjust the impedance.

Although, in each embodiment mentioned above, explanations are directed to the case in which the present invention is applied to the multi-band antenna being possible to operate in a plurality of frequency bands, the present invention should not be construed to be limited to the application set forth hereinbefore and is also applicable widely to the compact antennas having wide-band characteristics in particular frequencies, provided that the multi-band antenna has the dielectric having the three-layered structure, fed element, and grounded parasitic element shown in such as FIG. 1.

Moreover, although each element set forth in each embodiment mentioned above is configured so as to include the elements in two or three row obtained by connecting two or three line conductors and then folding the connected line conductor, the present invention is also applicable to the case that the antenna elements are configured so as to include more line conductors folded into more than three.

A method for adjusting the multi-band antenna in accordance with each of the above mentioned embodiment of the present invention is explained with referring to the accompanying drawings. For the adequate operation of the multi-band antenna, it is necessary to adjust the resonant frequency bands and the impedance out of the antenna characteristics.

Figure 13:
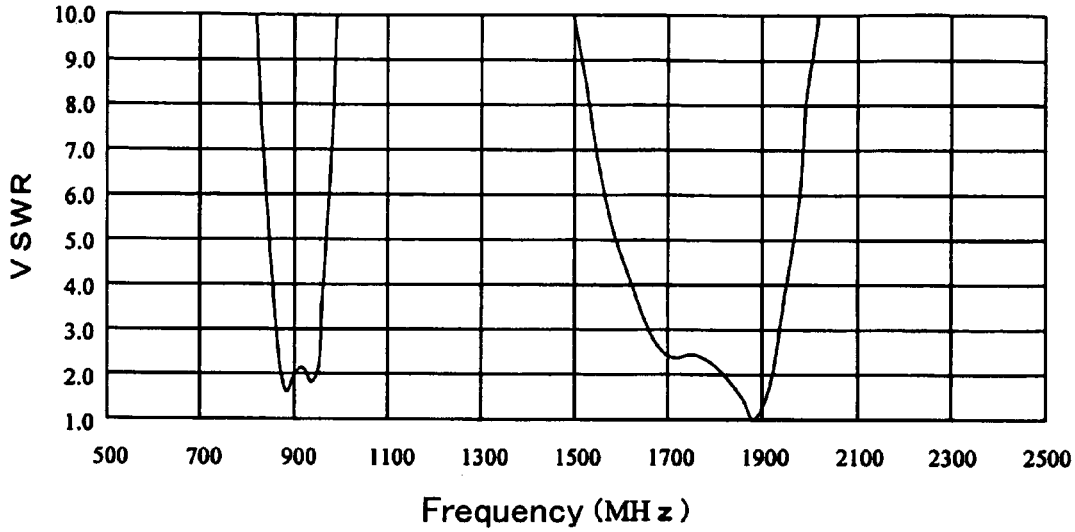
FIG. 13 is a graph that shows a VSWR vs. frequency characteristic which is one of the examined antenna characteristics of the multi-band antenna in accordance with the first embodiment.

VSWR shows resonant frequencies and their bandwidths and it is possible to set a frequency range in which VSWR is roughly less than three as the operation frequency bands of the multi-band antenna. Hereinafter, the antenna characteristics in accordance with the first embodiment is explained first by taking an example of the multi-band antenna 1 of which the configuration is in accordance with that of illustrated in FIG. 9. FIG. 13 is a view that illustrates the frequency characteristic of VSWR out of the examined antenna characteristics of the multi-band antenna in accordance with the first embodiment. Likewise, Table 1 shows design parameters of the multi-band antenna 1, which is assumed in the examination of the frequency characteristic of VSWR illustrated in FIG. 13, so as that the multi-band antenna 1 operates in the three frequency bands consist of GSM, DCS, and PCS.

TABLE 1

| Item | Design parameters |
|---|---|
| Specific dielectric constant of the first dielectric layer | 18.2 |
| Specific dielectric constant of the second dielectric layer | 4.5 |

TABLE 1-continued

| Item | Design parameters |
|---|---|
| Specific dielectric constant of the third dielectric layer | 18.2 |
| Antenna size: Length | 28.5 mm |
| Antenna size: Width | 7.5 mm |
| Antenna size: Height | 3 mm |

Based on the design parameters shown in Table 1, the frequency dependence of VSWR is measured on the multi-band antenna 1 in accordance with the first embodiment, which leads to the result illustrated as a curve shown in FIG. 13 in the frequency range between 500 and 2500 MHz. Herein, in the examination, an external matching circuit was connected to the multi-band antenna in order to obtain a complete impedance matching. As can be seen form FIG. 13, it is found that there appears a peak of VSWR around the frequency of 900 MHz and also appears a peak of VSWR between the frequencies of 1700 and 1900 MHz.

Assuming frequency ranges where VSWR is less than or equal to 3 as operation frequency ranges of the multi-band antenna 1, in FIG. 13, a frequency band of 94 MHz width in the lower frequency is secured, a frequency band of 280 MHz width in the upper frequency is secured, and each band width corresponds to the specific frequency band of 10.3% and 15.6% respectively. It is certified that all the frequency bands of GSM, DCS, and PSC is available based on these frequency ranges secured in each lower and higher frequency.

Regarding the multi-band antenna set forth in the first embodiment, in order to obtain the antenna characteristics shown in FIG. 12, the antenna size shown in Table 1 is able to be adopted and, in this case, a volume of the antenna corresponds to 641 mm3. To the contrary, in order to secure the similar antenna characteristics by employing the prior configuration, an antenna volume of more than one order of magnitude larger than that of the prior art is necessary. As mentioned above, the multi-band antenna 1 in accordance with the first embodiment makes it possible to reduce the volume of the antenna necessary for securing the desired antenna characteristics one order of magnitude smaller than that of the prior art.

Figure 14:
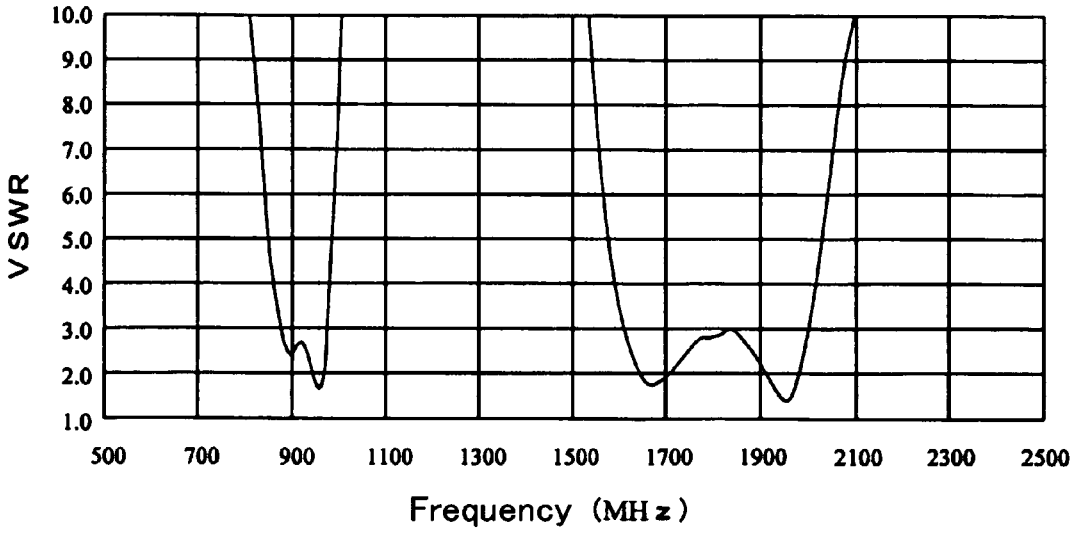
FIG. 14 is a graph that shows a VSWR vs. frequency characteristic which is one of the examined antenna characteristics of the multi-band antenna in accordance with the second embodiment.

Next, an explanation is carried out on the antenna characteristics of the multi-band antenna in accordance with the second embodiment. FIG. 14, similar to FIG. 13 referred in the first embodiment, is a view that illustrates the frequency dependence of the VSWR examined by taking the multi-band antenna which has a configuration in accordance with that illustrated in FIG. 11 as an example. Herein, the examination for obtaining the result shown in FIG. 14 is carried out by adopting the design parameters similar to those of listed in Table 1 described in the first embodiment.

The measurement on the frequency dependence of VSWR is performed for the multi-band antenna 2 in accordance with the second embodiment and the graph illustrated in FIG. 14 was obtained in the frequency range from 500 to 2500 MHz. Herein, it is similar to the case of the first embodiment that an external matching circuit was connected to the multi-band antenna 2. This graph shows that there is a tendency similar to that of being described in the first embodiment and two peaks appear in VSWR curve. By configuring as mentioned above, as operation bands of the multi-band antenna 2 in which VSWR is roughly less than or equal to three, a band width of 91 MHz is secured in the lower frequency and a band width of 383 MHz is secured in the higher frequency, and the specific band width of each band corresponds to 9.8% and 21.2% respectively. It is certified that all the frequency bands of GSM, DCS, and PSC is available, based on these frequency ranges secured in each lower and higher frequency.

Figure 15:
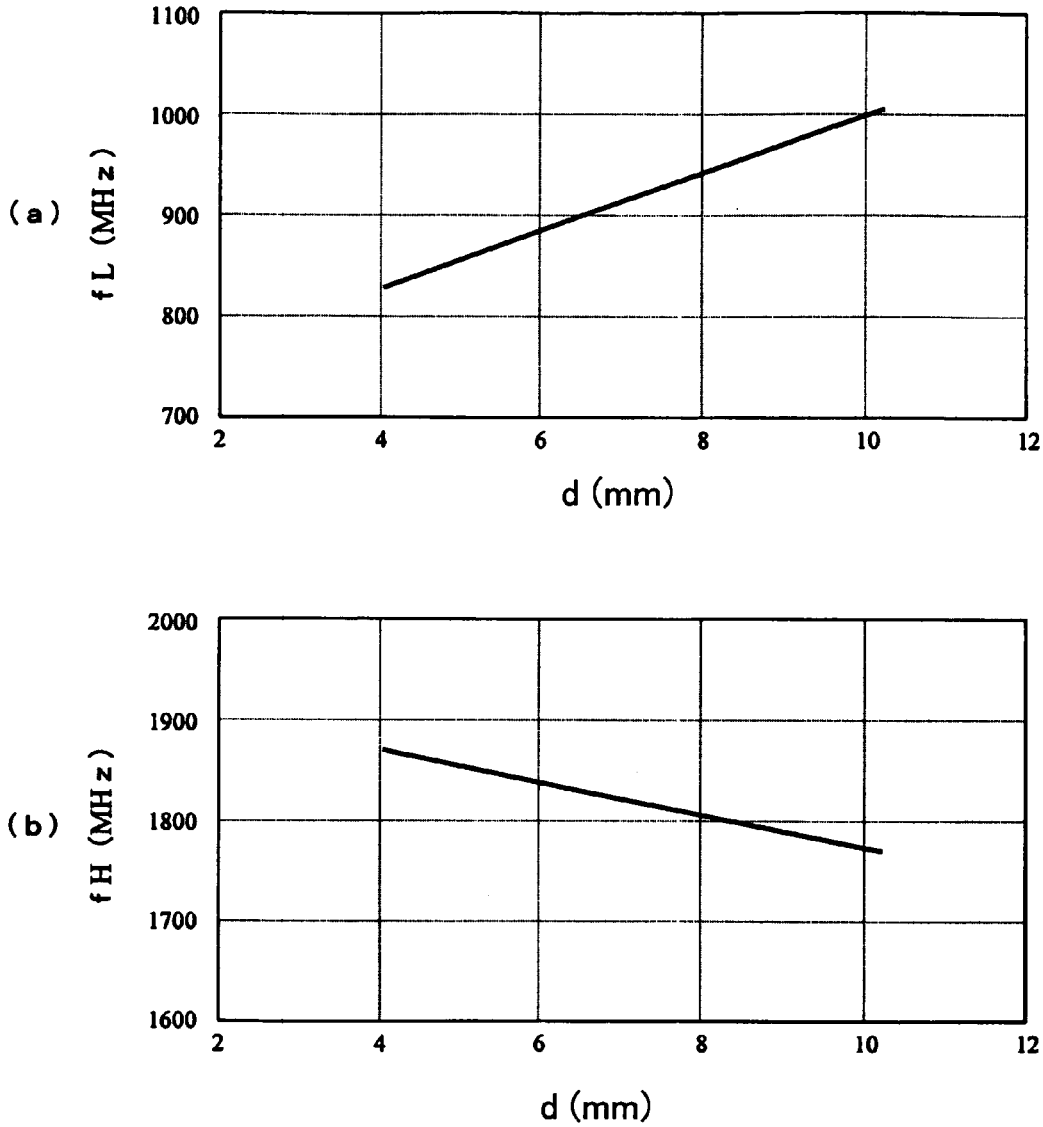
FIG. 15 is a schematic view that illustrates an example of adjusting the frequency characteristics of the multi-band antenna with varying the distance between open ends of the base ends.

Referring now to the antenna characteristics of the multi-band antenna 1 in accordance with the first embodiment, a method for adjusting the antenna characteristics is explained. In the adjustment of the resonant frequencies, the design parameters, etc. are adjusted so as that the frequency bands in which VSWR shown in the graph illustrated in FIG. 13 is less than or equal to three coincide the desired frequency bands. An example of the change in VSWR, obtained by adjusting the distance 48 from the base end to the open end shown in FIG. 9 as one of the design parameters, is illustrated in FIG. 15. Based on FIG. 15(*a*), it is found that, by reducing the distance (d) from the base end to the open end, the resonant frequency in the lower frequency can be shifted lower. On the other hand, as shown in FIG. 15(*b*), the resonant frequency in the higher frequency shifts higher by reducing the distance (d) from the base end to the open end. Herein, since the amount of shift of the upper resonant frequency is small and the higher resonant frequency can be adjusted easily by adjusting the other design parameters, it is preferable to adjust the lower resonant frequency by adjusting the distance from base end to open end.

Figure 17:
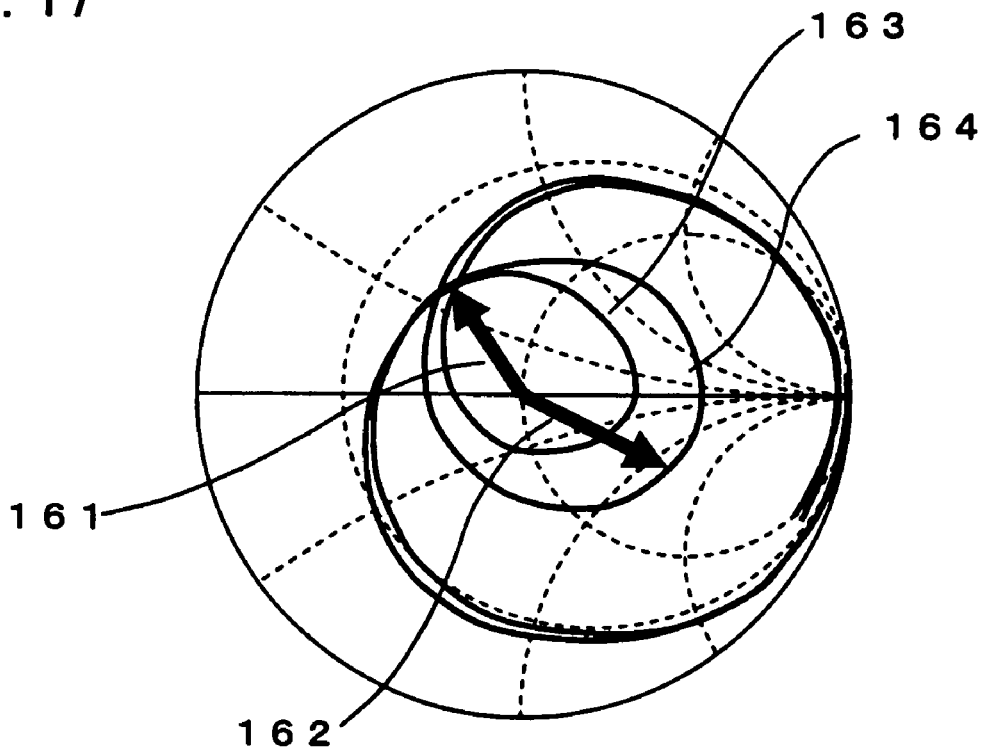
FIG. 17 is a chart that illustrates a Smith Chart used for adjusting the impedance of the multi-band antenna.

Next, a method being carried out by using Smith Chart is explained as a method for adjusting the impedance. FIG. 17 shows an example carried out by using Smith Chart, in which a reflection coefficient is illustrated and a vector S161 represents the vector drawn from the origin to the starting point of a frequency locus and a vector S162 represents the vector drawn from the origin to the top of a frequency locus. Moreover, loci 163 and 164 represent a frequency locus in the lower frequency region and that of in the higher frequency region, respectively. While the object of the adjustment of the impedance is to broaden the frequency band, |S| and |R-S|, i.e., respective magnitudes of vectors S and R-S, can be adopted as a measure of broadening the band width. Under the condition mentioned above that VSWR<3, the frequency band has the maximum width when $$|S|=0.5 \text{ and } |R-S|=1.0 \qquad \text{(formula 3)}$$

are satisfied.

Therefore, in the adjustment of impedance, it is possible to contrive to broaden the frequency bands by adjusting design conditions so as to be close to the condition mentioned above.

Figure 16:
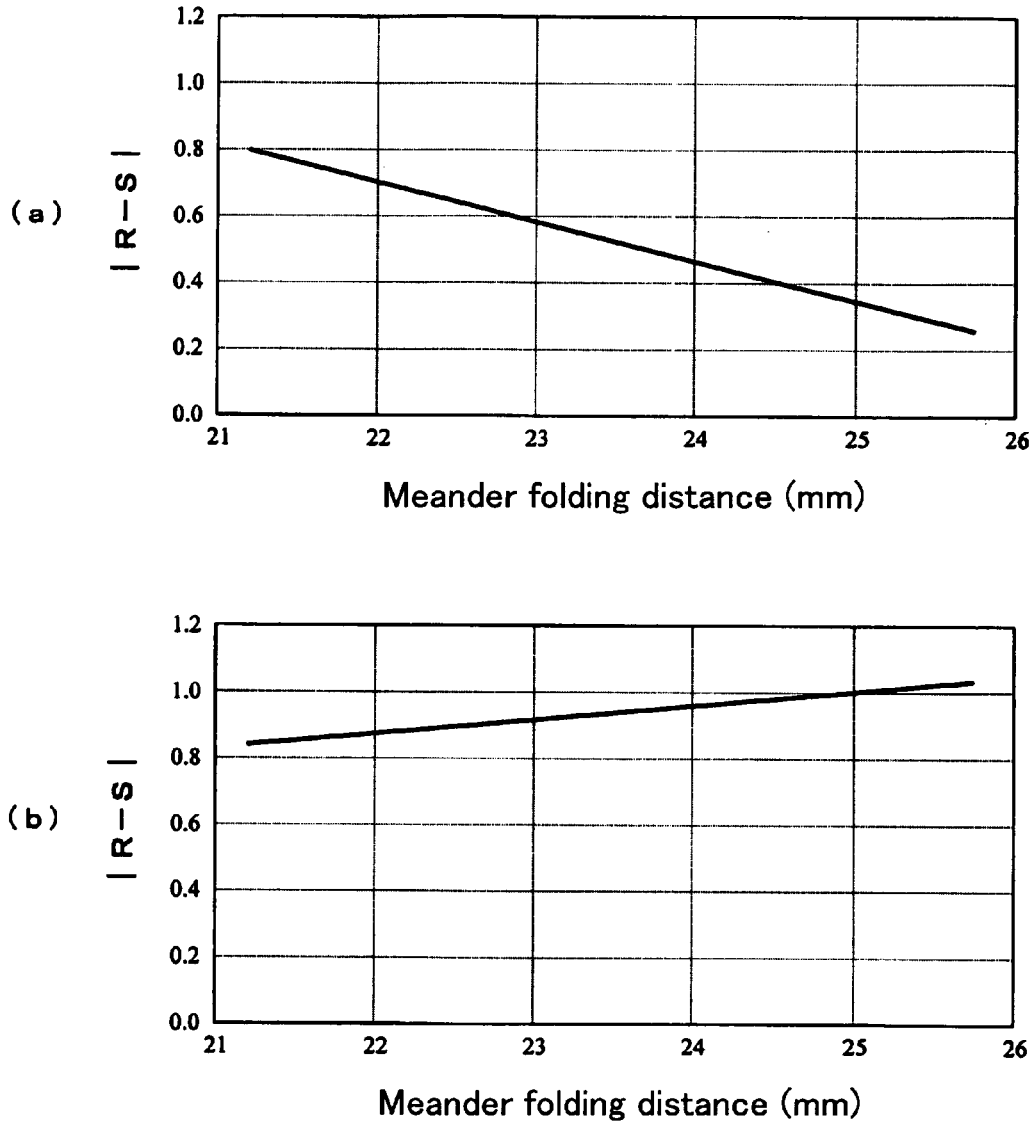
FIG. 16 is a view that illustrates an example of adjusting the impedance of the multi-band antenna with varying the meander-folding distance specified for the fed element.

As one of the design parameters for adjusting the impedance, there is a meander-folding distance 49 shown in FIG. 9. An example of the variation of |R-S| associated with the variation of the meander-folding distance 49 is shown FIG. 16. FIGS. 16(*a*) and (*b*) illustrate the variation of |R-S| in the lower frequency region and the higher frequency region respectively. Based on FIG. 16, it is preferable to satisfy, as possible as could, the condition that |R-S|=1.0 and adjust the meander-folding distance so as that |R-S|s in the lower frequency region and higher frequency region become similar in value each other. In other words, it is preferable to adjust so as that the frequency locus 163 in the lower frequency region and the frequency locus 164 in the higher frequency region have circular shapes having a similar radius. Herein, although there are some case that the other condition |S|=0.5 expressed in the Eq. 3 is violated badly by the adjustment of the impedance like this, this deviation can easily be adjusted by using the external matching circuit.

In addition, as for adjusting the antenna characteristics of the multi-band antenna, the resonant frequency and the impedance can also be adjusted by varying the position and the length of the air hole described in claims 3 and 4.

The compact antenna 1 in accordance with each embodiment mentioned above has a three layer structure that is formed by sandwiching the central dielectric layer 12 made of a low dielectric constant material between the upper and lower dielectric layers 11 and 13 made of a high dielectric constant material. Among them, it is preferable to adopt resins such as PEI (PolyEtherImide), LCP (Liquid Crystal Polymer) as the central dielectric layer 12 made of the low dielectric constant material. Moreover, as the outer layers made of high dielectric constant materials, resins mixed with ceramics are employed.

As mentioned above, the fed element 21 and grounded parasitic element 22 are formed on the both surfaces of the central dielectric layer 12, Glass-Epoxy materials are generally employed as materials for such a both sided printed circuit board. Hereinafter, an explanation is carried out on the effects of adopting resins such as PEI, LCP in place of Glass-Epoxy materials as low dielectric constant materials placed in the central portion of the compact antenna 1 in accordance with the invention. Since being thermosetting resins, Glass-Epoxy materials have a character that is hard to deform even if they are heated. On the other hand, since being thermoplastic, the PPS being adopted as a high dielectric constant material for the outer layer has a character that is easy to deform by heating. As mentioned above, since the thermal properties of the outer layer and inner layer are quite different from each other, especially the coefficient of the linear thermal expansion, there is a problem that is difficult to form it. Moreover, there is also a problem that a crack could occur under some temperature circumstances.

To the contrary, by adopting thermoplastic resins such as PEI, LCP in place of Grass-Epoxy as a low dielectric constant material for the inner layer, thermal properties, especially linear expansion coefficients, of the inner layer and outer layer can have similar values each other, which not only makes it easy to form, but also possible to improve remarkably the resistance to the thermal circumstances. Moreover, since Glass-Epoxy materials have large tan delta, a dielectric loss increases under the operation in the high frequency region, which causes a problem of degrading the emissivity. To the contrary, since resins such as PEI, LCP have a dielectric tangent about one order of magnitude smaller than that of Glass-Epoxy, a thermal loss can be decreased by adopting PEI or LCP. Furthermore, as to the Glass-Epoxy antenna 1 having the three layered structure in accordance with the present invention, the thickness of the central dielectric layer 12 becomes an important parameter that affects antenna characteristics, wherein the Glass-Epoxy substrate for general-purpose is not easy to adjust its thickness and has large scatter of the thickness, to the contrary, in case of adopting resins such as PEI, LCP, there also exists an advantage of adjusting the thickness easily.

The method for manufacturing the compact antenna 1 in accordance with the present invention is explained hereinafter. The compact antenna 1 in accordance with the present invention has three-layer structure obtained by stacking three layers so as that the central dielectric layer 12 made of the low dielectric constant material is sandwiched inside the dielectric layers 11 and 13 made of high dielectric constant materials, and the fed element 21 is formed between the central dielectric layer 12 and the upper dielectric layer 13, and the grounded parasitic element 22 is formed between the central dielectric layer 12 and the lower dielectric layer 11.

For the compact antenna 1 in accordance with the present invention having a configuration such as described above, a fabrication method is adopted in which the fed element 21 and grounded parasitic element 22 are formed on the upper side and lower side of the central dielectric layer 12 made of low dielectric constant material respectively, then the outer dielectric layers 11 and 13 made of high dielectric constant sandwich them.

Therefore, an explanation is carried out on a method for manufacturing the central dielectric layer 12 made of low dielectric constant material, on which the fed element 21 and grounded parasitic element 22 is formed. In the fabrication method which adopts the Glass-Epoxy substrate, patterns are formed by performing the following steps; i.e., coating resist on the both sides of Glass-Epoxy board on which cupper films are plated on the full surface, exposing for patterning, etching for patterning, removing resist, and performing surface treatment, in this order.

To the contrary, in the first fabrication method which employs resins such as PEI, LCP as the low dielectric constant materials at central position, a cast formed to the shape of an antenna by applying the injection molding technique is etched chemically and cupper is plated thereon by using electroless or electro plating technique. Next, patterns are formed by laminating dry film resist, exposing for patterning, etching for patterning, removing resist, and performing surface treatment, in this order. In first fabrication method like this, patterns are formed by plating cupper on the full surface and then removing the cupper from areas where the elements are not to be formed, which results in that a large potion of cupper is to be removed since the areas being formed the elements is to the extent of ⅓ to ¼ of all area.

Therefore, in the second fabrication method, to the resin formed to the shape of an antenna by applying injection mold technique, a surface treatment is carried out by adopting, for example, corona discharge technique only on the portions where the elements are to be formed. Next, in order to render an anchor function to the plated cupper, printing nuclei using electroless plating technique or printing dielectric paint is performed first on the portion where the surface treatment was carried out. Then, the electro plating or electroless plating is carried out to complete the elements. By adopting the second fabrication method, big effects are obtained such as cost down which becomes possible by reducing the amount of cupper used, simplifying the fabrication processes.

What is claimed is:

1. A compact antenna comprising;

a dielectric having a three-layer structure formed by stacking dielectric layers so that a first dielectric layer made of a low dielectric constant material is sandwiched by second and third dielectric layers made of high dielectric constant materials, a fed element formed between said first dielectric layer and said second dielectric layer, a base end of the fed element being connected to a feed point around a specified side face of the dielectric having the three-layer structure, and a grounded parasitic element formed between said first dielectric layer and said third dielectric layer, a base end of the grounded parasitic element being grounded on said specified side face.

2. The compact antenna according to claim 1 further comprising: a shorting conductor for electrically connecting an open end of said fed element and an open end of said grounded parasitic element through said first dielectric layer.

3. The compact antenna according to claim 1, wherein said fed element and said grounded parasitic element have elements that include line conductors formed so as to obtain a plurality of reflection points.

4. The compact antenna according to claim 1, wherein said fed element and said grounded parasitic element are each respectively formed from respective the base end to said respective open end by connecting a plurality of line conductors and folding at least around a side face opposite to said specified side face.

5. The compact antenna according to claim 3, wherein at least to an outer layer of said dielectric having the three-layer structure, low dielectric constant patterns are formed which have a dielectric constant lower than that of said dielectric.

6. The compact antenna according to claim 5, wherein said low dielectric constant patterns are formed between conductors in double row, each of which consists of said line conductors.

7. The compact antenna according to claim 5, wherein said low dielectric constant patterns are formed by air holes (slits).

8. The compact antenna according to claim 1, wherein said fed element and said grounded parasitic element include line conductors folded in triple row, each line conductor being obtained by folding around said specified side face and around a side face opposite to said specified side face, and a respective central conductor of each of said fed element and said grounded parasitic element folded in triple row is placed on a first position opposite each other on respective sides of the first dielectric layer.

9. The compact antenna according to claim 1, wherein said fed element and said grounded parasitic element are placed on shifted positions in the direction of the plane of each dielectric layer.

10. The compact antenna according to claim 1, wherein said fed element and said grounded parasitic element are configured with conducting elements having the same shape each other.

11. The compact antenna according to claim 1, wherein either or both of said fed element and said grounded parasitic element include a meander line.

12. The compact antenna according to claim 1, wherein said dielectric having the three-layer structure is placed in a notch portion obtained by removing a corner of a ground plane, and on said circuit board, a feed point being connected with the base end of said fed element and a ground point being connected with the base end of said grounded parasitic element are provided.

13. The compact antenna according to claim 12, wherein said dielectric having the three-layer structure is placed in said notch portion so that the direction of the face of said each dielectric layer and the direction of the face of said circuit board approximately coincide with each other.

14. The compact antenna according to claim 12, wherein said dielectric having the three-layer structure is placed in said notch portion so that the direction of the face of said each dielectric layer and said circuit board is approximately perpendicular to each other.

15. The compact antenna according to claim 1, wherein said dielectric layer made of the low dielectric constant material is formed by using resins such as PolyEtherImide (PEI), Liquid Crystal Polymer (LCP).

16. The compact antenna according to claim 3, wherein a resonant frequency corresponding to said each reflection point is tuned by adjusting a spatial distance between said base end and said reflection points of said conducting element.

17. The compact antenna according to claim 16 wherein impedance in said each resonant frequency is tuned so as to coincide with each other by adjusting a relative distance between the folding positions of said fed element and said grounded parasitic element.

18. The compact antenna according to claim 17 wherein said resonant frequency and said impedance are tuned by adjusting at least the position and the length of said low dielectric constant patterns formed to the outer dielectric layer.

* * * * *